US008261955B2

(12) United States Patent
Wolf et al.

(10) Patent No.: US 8,261,955 B2
(45) Date of Patent: Sep. 11, 2012

(54) COMBUSTION-OPERATED SETTING DEVICE

(75) Inventors: Iwan Wolf, Untervaz (CH); Ulrich Schiestl, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 1154 days.

(21) Appl. No.: 11/807,678

(22) Filed: May 29, 2007

(65) Prior Publication Data

US 2007/0290020 A1 Dec. 20, 2007

(30) Foreign Application Priority Data

May 30, 2006 (DE) ..... 10 2006 000 262

(51) Int. Cl.
*B25C 1/08* (2006.01)

(52) U.S. Cl. ..... 227/10; 227/9

(58) Field of Classification Search ..... 227/9, 10; 123/46 SC

See application file for complete search history.

(56) References Cited

U.S. PATENT DOCUMENTS 6,123,241 A * 9/2000 Walter et al. ..... 227/8
6,895,933 B2 * 5/2005 Miwa et al. ..... 123/406.47

* cited by examiner

*Primary Examiner* — Lindsay Low
*Assistant Examiner* — Nathaniel Chukwurah
(74) *Attorney, Agent, or Firm* — Abelman, Frayne & Schwab

(57) ABSTRACT

The present invention is directed to a combustion-operated setting device (10) with a combustion chamber (12) for a combustible propellant, an ignition device (16) for generating an ignition spark in the combustion chamber (12), a metering device (13) for metering the propellant, and control electronics (30) for the ignition device (16) and the metering device (13). In order to improve the control electronics (30), the control electronics (30) have at least two logically separated circuits. A first circuit (33) controls the metering device (13) and a second circuit controls the ignition device (16).

5 Claims, 2 Drawing Sheets

COMBUSTION-OPERATED SETTING DEVICE

BACKGROUND OF THE INVENTION

1. Field of the Invention

The present invention is directed to a combustion-operated setting device, and more specifically, to a setting device having control circuitry to reduce the effects of electromagnetic interference from an ignition device for generating an ignition spark to ignite fuel in the combustion chamber of the setting device.

2. Description of the Prior Art

Setting devices typically have a combustion chamber in which a portion of liquid gas or other vaporizable fuel can be burned with an oxidizing agent such as, e.g., the surrounding air. A setting piston which is displaceably guided in a piston guide is driven by the combustion energy to drive a fastener into an object.

U.S. Pat. No. 6,123,241 discloses a combustion-operated setting device which has an electronic control with a microprocessor for controlling ignition and injection. The setting device includes various sensors for measuring the atmospheric pressure and the fuel pressure. The apportioning and metering of the fuel from the fuel reservoir to the combustion chamber is controlled by a microprocessor based on the data acquired by the sensors. The microprocessor cooperates with a monitoring valve for monitoring the fuel.

The combined ignition and injection electronics disclosed in U.S. Pat. No. 6,123,241 are disadvantageous in that the electromagnetic compatibility (EMC) emission of the ignition spark can cause interference which affects the combined electronics in their entirety and, for example, can also influence a subsequent new injection of fuel.

SUMMARY OF THE INVENTION

An object of the present invention is a setting device which avoids the aforementioned disadvantages and ensures a trouble-free working operation.

According to the present invention, the control electronics have at least two logically separated circuits which can be electrically disconnected from one another, a first circuit controlling the metering device and a second circuit controlling the ignition device. This logical separation of the control and the electric, reversible disconnection of the circuits makes it possible to completely switch off the control of the metering device, i.e., the first circuit, at the latest when the ignition spark occurs to ensure that electromagnetic compatibility (EMC) interference that may be caused by the ignition sparks has no influence on the metering device and the control thereof. Consequently, erroneous metering and system errors of the metering device and of the first circuit controlling the metering device can be reliably prevented. The separation of the two circuits from one another can be limited to the logical and electrical connection of the structural component parts, while the two circuits can be physically constructed on the same print.

Further, it is advantageous when at least one of the two circuits has at least one microprocessor so that fast data processing is ensured even when there are many parameters provided as input values for the control. The first circuit and the second circuit preferably each have at least one microprocessor.

It is advantageous when the first circuit and the second circuit can each be activated by at least one switching means, respectively, and these switching means are independent from one another. In this manner, it is possible for the injection to take place as soon as possible so that there is sufficient time between the injection and the ignition for the evaporation of the combustion gas.

The two circuits are each advantageously provided with their own power source for supplying them with electric power so that multiple expenditures in manufacturing are prevented and a small structural volume is achieved. The power supply through the power source can preferably be disconnected from the first circuit and second circuit or connected with them, respectively, simultaneously by means of additional switching means. Accordingly, when the power supply is switched off, the two circuits are electrically disconnected simultaneously.

Further advantages and features of the present invention will become apparent from the detailed description of a preferred embodiment of the invention with reference to the accompanying drawings.

Figure 1:
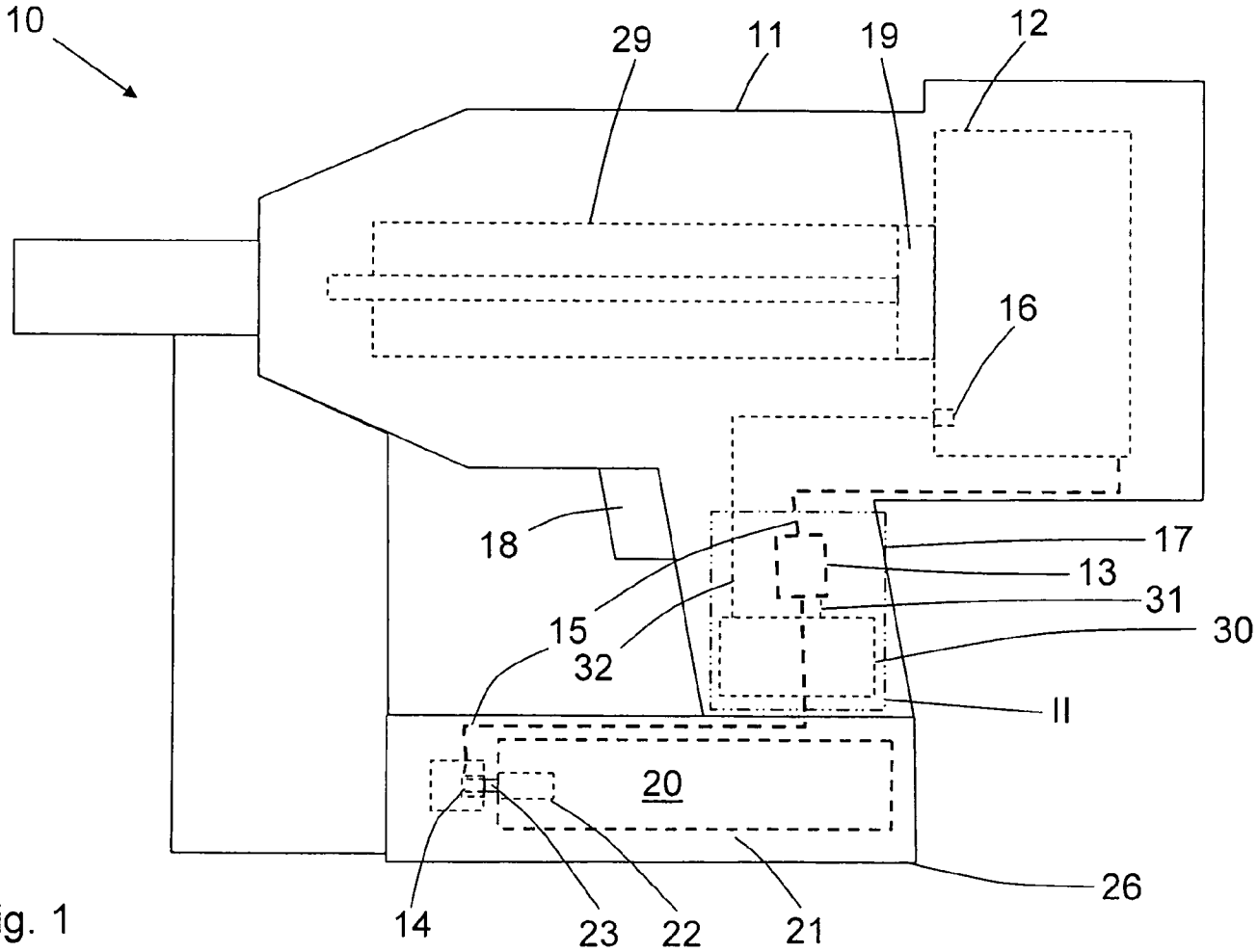
FIG. 1 a schematic view of a setting device according to the present invention.

To facilitate understanding of the invention, identical reference numerals have been used, when appropriate, to designate the same or similar elements that are common to the figures. Further, unless stated otherwise, the drawings shown and discussed in the figures are not drawn to scale, but are shown for illustrative purposes only.

DETAILED DESCRIPTION OF THE PREFERRED EMBODIMENT

Figure 2:
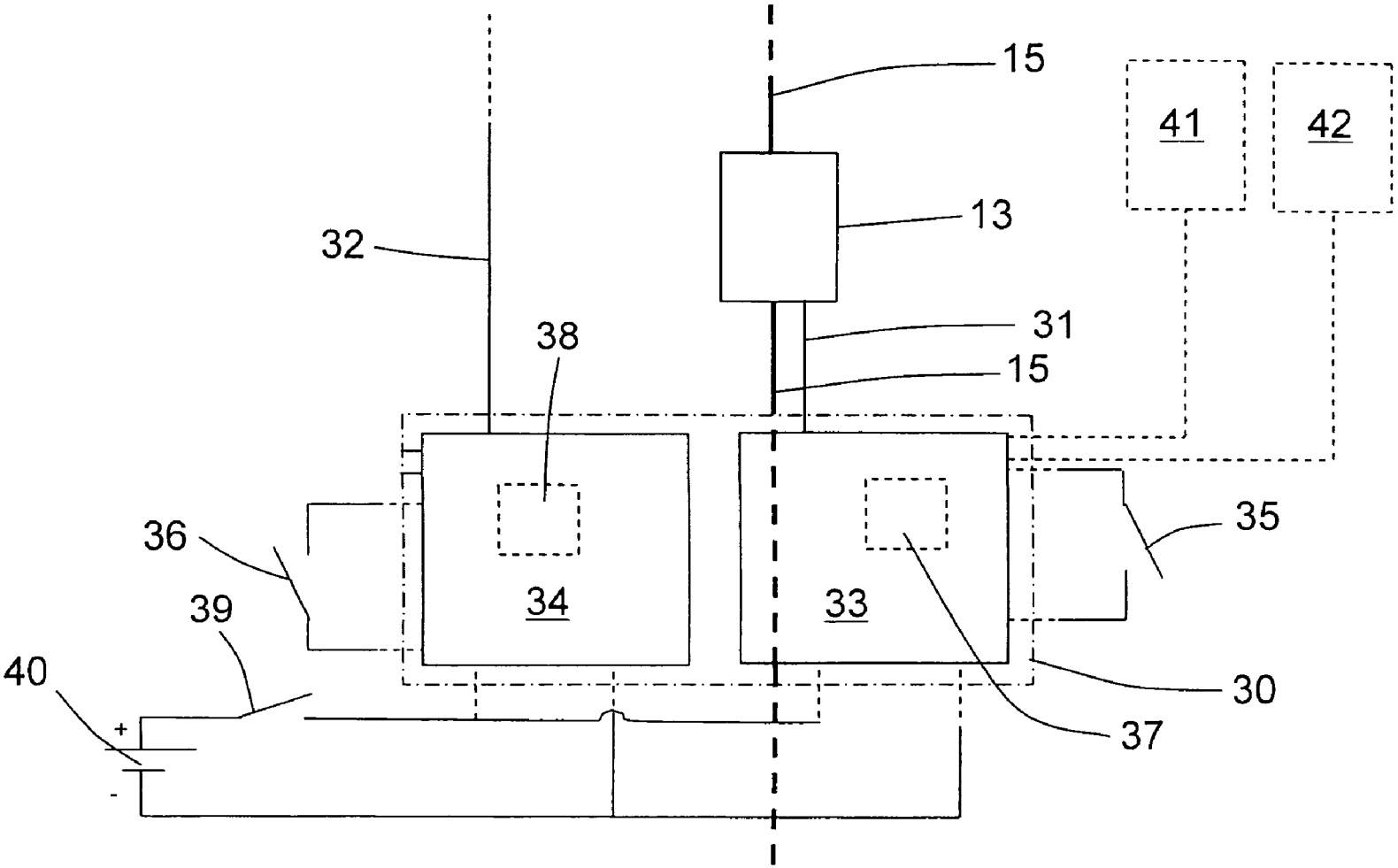
FIG. 2 an exploded detail view of control circuitry of the setting device along block II of FIG. 1.

FIGS. 1 and 2 show a setting device 10 according to the invention which can be operated by a liquid or gaseous fuel as propellant and which has a propellant vessel 20. The setting device 10 has a housing 11 with a handle 17 formed thereon at which there is a trigger switch 18 for initiating a setting process. The setting device 10 further has a setting mechanism which contains a combustion chamber 12 for burning an air/propellant mixture and a setting piston 19 which is displaceably guided in a piston guide 29 and by means of which a fastener can be driven into a workpiece.

A propellant vessel 20 is arranged in a propellant vessel holder 21 of the setting device 10 in an exchangeable manner and in one embodiment, is illustratively constructed as a gas can that contains a liquid gas. The propellant vessel 20 has at one end a valve outlet 23 of a valve 22 such as, e.g., a stem by which propellant can be dispensed from the propellant vessel 20. For this purpose, a connection element 14, e.g., a connection piece, is arranged in the propellant vessel holder 21 and is connected to the valve outlet 23 when the propellant vessel 20 is fully inserted into the propellant vessel holder 21 as can be seen from FIG. 1. The propellant vessel can then be connected to the combustion chamber 12 by means of a propellant line 15 proceeding from the connection element 14.

A metering device 13 which influences the feed of propellant to the combustion chamber 12 is arranged in the propellant line 15. For this purpose, the metering device 13 comprises, e.g., an electronically controllable valve and can be constructed as a fuel injection device.

An ignition device 16, e.g., a spark plug, by which a combustion process can be initiated in the combustion chamber 12 is arranged in the combustion chamber 12. The ignition device 16 and the metering device 13 are controlled electronically by control electronics which are designated in their entirety by 30 and shown in more detail in FIG. 2. Referring to FIG. 2, the control electronics 30 have two circuits 33, 34 which can be logically disconnected from one another. The first circuit 33 controls the metering device 13 and the second circuit 34 controls the ignition device 16.

The first circuit 33 has a first microprocessor 37 which determines the metering amount of propellant required for a setting process based on stored data and measurement data of sensing means 41, 42, which are connected to the first circuit, and conveys control commands to the metering device 13. In one embodiment, the first circuit 33 is connected to the metering device 13 by a first control line 31. First sensing means 41 serve to acquire the ambient temperature, while second sensing means 42 serve to acquire the atmospheric pressure.

First switching means 35 are arranged at the setting device 10 and are constructed, e.g., as a nose-shaped switch, in the muzzle area of the setting device 10. The first circuit 33 can be activated independent from the second circuit 34 by the switching means 35, e.g., when the setting device is pressed against a workpiece or a substrate.

The second circuit 34 has a second microprocessor 38 which controls the ignition by the ignition device 16. The second circuit 34 is connected to the ignition device 16 for this purpose by a second control line 32, as shown in FIG. 1. Second switching means 36 (FIG. 2) which are, e.g., coupled with the trigger switch 18 or formed by the trigger switch itself are arranged at the setting device 10. The second circuit 34 can be activated independent from the first circuit 33, e.g., when the setting device 10 is triggered by the trigger switch 18, by means of these second switching means 36. Alternatively, the second switching means 36 could also be connected only indirectly following an actuation of the trigger switch 18.

By means of the logical separation of the first circuit 33, which controls the metering device 13, from the second circuit 34, which controls the ignition device 16, it is possible for the control of the metering device 13, i.e., the first circuit 33, to be switched off completely at the latest when the ignition spark is generated so that EMC interference occurring during the ignition through the ignition device 16 cannot affect the control of the metering device 13.

A power source 40, e.g., one or more batteries or accumulators, is provided for supplying electric power and is connected by supply lines to the first circuit 33 and second circuit 34, respectively (see FIG. 2). Although the present invention is described in terms of a single power source 40, a person skilled in the art will appreciate that separate power sources can also be provided for each of the circuits 33 and 34. The power source 40 can be connected to the circuits 33, 34 and can supply the latter with electric power by additional switching means 39. When the ignition control 34 releases the ignition, which is carried out by discharging at least one capacitor, the ignition control 34 causes the switch 39 to open, which immediately results in a switching off of the metering control 33. The ignition is now concluded by the energy stored in the above-mentioned capacitor.

Although the present invention is described in terms of a single power source 40, a person skilled in the art will appreciate that separate power sources can also be provided for each of the circuits 33 and 34.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

We claim:

1. A combustion-operated setting device, comprising:

a combustion chamber (12) for a combustible propellant;

an ignition device (16) for generating an ignition spark in the combustion chamber (12);

a metering device (13) for metering the propellant; and control electronics (30) for the ignition device (16) and the metering device (13) having at least two logically separated circuits (33, 34) which can be electrically disconnected from one another, a first circuit (33) controlling the metering device (13) and a second circuit controlling the ignition device (16).

2. The combustion-operated setting device according to claim 1, wherein at least one of the two circuits (33, 34) has at least one microprocessor (37, 38).

3. The combustion-operated setting device according to claim 1, wherein the first circuit (33) and the second circuit (34) can each be activated by at least one switching means (35, 36), respectively, said switching means (35, 36) being independent from one another.

4. The combustion-operated setting device according to claim 1, wherein the two circuits (33, 34) are supplied with electric power by a power source (40).

5. The combustion-operated setting device according to claim 4, wherein the electric power from the power source (40) can be disconnected from the first circuit (33) and from the second circuit (34) by additional switching means (39).

* * * * *